US006308820B1

(12) United States Patent
Munneke

(10) Patent No.: US 6,308,820 B1
(45) **Date of Patent: *Oct. 30, 2001**

(54) ASSEMBLY FOR CONVEYING STACKED DOCUMENTS

(75) Inventor: Christiaan Antoon Munneke, Surhuisterveen (NL)

(73) Assignee: Hadew B.V., Drachten (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/759,181

(22) Filed: Dec. 4, 1996

(30) Foreign Application Priority Data

Dec. 5, 1995 (NL) ..... 1001828

(51) Int. Cl.[7] ..... B65G 15/12

(52) U.S. Cl. ..... 198/626.2; 198/624; 198/620; 271/273; 271/274

(58) Field of Search ..... 198/620, 622, 198/624, 626.2, 626.3, 626.4; 271/273, 274; 493/445; 270/52.19

(56) References Cited

U.S. PATENT DOCUMENTS 1,849,238 * 3/1932 Lindgren ..... 270/52.19
2,957,574 * 10/1960 Compton ..... 198/624 X
3,246,822 * 4/1966 Skeen ..... 226/155
3,844,399 * 10/1974 Sellers, Jr. et al. ..... 198/165
5,094,443 * 3/1992 Young, Jr. ..... 271/245
5,303,913 * 4/1994 Trouquilla ..... 271/274
5,426,497 * 6/1995 Morganti et al. ..... 335/317
5,673,910 * 10/1997 Wamsley ..... 198/624 X

FOREIGN PATENT DOCUMENTS 0 535 543 4/1993 (EP) .

* cited by examiner

*Primary Examiner*—Joseph E. Valenza
*Assistant Examiner*—Patrick Mackey
(74) *Attorney, Agent, or Firm*—Burns, Doane, Swecker & Mathis, LLP

(57) ABSTRACT

An assembly for conveying stacked documents includes a conveying surface extending along the conveying path and a conveyor roller that is suspended opposite to the conveying surface for movement between positions at different distances from the conveying surface. In the operating condition, the conveyor roller exerts a press-on force. The assembly also includes a transmission for driving the conveyor roller. The transmission is coupled with the conveyor roller in such a manner that if a couple is exerted on the conveyor roller in the conveying sense, a force directed against this press-on force is exerted on the conveyor roller. As a result, the temporary increase of the couple and the temporary reduction of the circumferential speed of the conveyor roller is limited.

21 Claims, 5 Drawing Sheets

ASSEMBLY FOR CONVEYING STACKED DOCUMENTS

FIELD OF THE INVENTION

This invention relates to an assembly for conveying stacked documents along a particular conveying path in a conveying direction.

Such assemblies are used inter alia for conveying documents and annexes gathered into a stack, to an inserting position in an inserter station.

BACKGROUND OF THE INVENTION

In practice, assemblies for conveying stacked documents along a particular conveying path in a conveying direction are typically provided with a circulating conveying surface having a section extending along the conveying path and with a conveyor roller which is suspended opposite the section of the circulating conveying surface for reciprocating movement between positions at different distances from that section of the circulating conveying surface and in operating condition exerts a press-on force in the direction of that section of the circulating conveying surface, and a transmission for driving the conveyor roller with a couple in the conveying sense, which couple causes the conveyor roller to rotate in operation in such a manner that a circumferential section of the conveyor roller facing the above-mentioned section of the conveying surface is moved in the conveying direction.

In conveying a stack of documents, the problem occurs that when the stack is brought between a conveyor roller and a conveying surface, an irregularity in the conveyance occurs each time the conveyor roller, or at least a belt extending around the conveyor roller, butts against the leading edge of the stack. More particularly, a shock load is produced, which is stronger according as the stack is thicker.

Further, the documents stacked onto each other are shifted relative to each other in the conveying direction. Stacked documents that have shifted relative to each other in the conveying direction are difficult to process further. If the next operation consists, for instance, in inserting the documents into an envelope, the chances of problems are increased, because the total length of the stack in the conveying direction has increased and the documents must, at least partly, shift back relative to each other again so as to allow closure of the envelope with the documents inserted therein. Owing to increased relative friction of the documents brought between the walls of the envelope, alignment or re-alignment of documents in the envelope is relatively unreliable.

If the next operation consists, for instance, in the folding of the stack of documents, only a very slight relative shift of the supplied documents gathered into a stack can be accepted, because the relative shift can no longer be undone after a fold in a direction transverse to the conveying direction has been provided.

SUMMARY OF THE INVENTION

The object of the invention is to provide an assembly for conveying documents gathered into a stack, whereby the entry of the stacked documents between the conveyor roller and the conveying surface located opposite the conveyor roller is accompanied by a lesser shock load and whereby the stacked documents while passing between the conveyor roller and the conveying surface located opposite the conveyor roller, shift relative to each other to a lesser extent.

This object is achieved according to the present invention in that in an assembly of the type as discussed hereinbefore the transmission is coupled with the conveyor roller in such a manner that if the transmission exerts a couple on the conveyor roller in the conveying sense, it also exerts a force on the conveyor roller directed against the press-on force.

The invention utilizes the following insights. The infeed of thicker stacks of documents gives rise to a temporary increase of the resistance to be overcome, inasmuch as the conveyor roller, while rolling over the leading edge of the stack, is moved against the press-on force. This results in a temporary reduction of the circumferential speed of the conveyor roller and a temporary increase of the driving couple exerted. This effect is further enhanced in that the transmission of a greater couple also gives rise to a greater friction in the transmission.

By virtue of the feature that the transmission is coupled with the conveyor roller in such a manner that while the couple is being exerted on the conveyor roller in the conveying sense, at the same time a force directed against the press-on force is exerted on the conveyor roller, the press-on force which the conveyor roller exerts in the direction of the conveying surface is temporarily reduced during the infeed of a stack of documents. As a result, in turn the temporary increase of the couple and hence the shock load of the assembly is limited. Also, attendant noise during the infeed is limited.

Owing to the peak load of the drive being limited, further the temporary reduction of the circumferential speed of the conveyor roller is limited. This counteracts shifting of documents on the side of the conveyor roller relative to the other documents in the stack due to variations in the conveying speed.

Hereinafter, the invention is further illustrated and explained on the basis of a number of exemplary embodiments with reference to the drawings.

DETAILED DESCRIPTION

Figure 8:
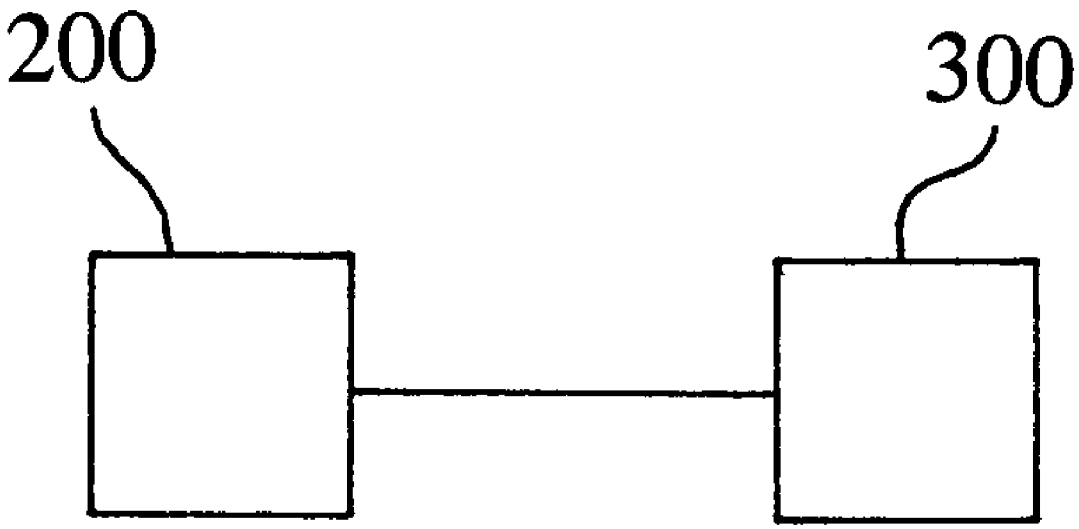
FIG. 8 is a schematic illustration of the way in which the conveying assembly is positioned with respect to an inserter station.

FIG. 8 is a schematic illustration of a conveying assembly 200 which conveys stacked documents to an inserter station 300 which inserts the documents conveyed by the conveying assembly 200.

FIGS. 1–5 show an embodiment of a conveyor according to the invention, or at least parts thereof, which is preferred most at present. The assembly according to this embodiment is intended for conveying stacked documents along a conveying path 2 in a conveying direction each time indicated by an arrow 1.

The assembly comprises a circulating conveying surface 3 in the form of a circumferential surface of a lower conveyor roller 4 with a section 5 extending along the conveying path 2. Opposite this section 5 of the circulating conveying surface 3, an upper conveyor roller 6 is suspended so as to be reciprocable between positions at different distances from the section 5 of the circulating conveying surface 3 facing the conveying path 2. Arranged between pivoting suspensions 7, 8 of the lower conveyor roller 4 and the upper conveyor roller 6 is a draw spring 9. The draw spring 9 pulls the upper conveyor roller 6 in operation in the direction of the section 5 of the circulating conveying surface 3 proximal to the conveying path 2.

Figure 1:
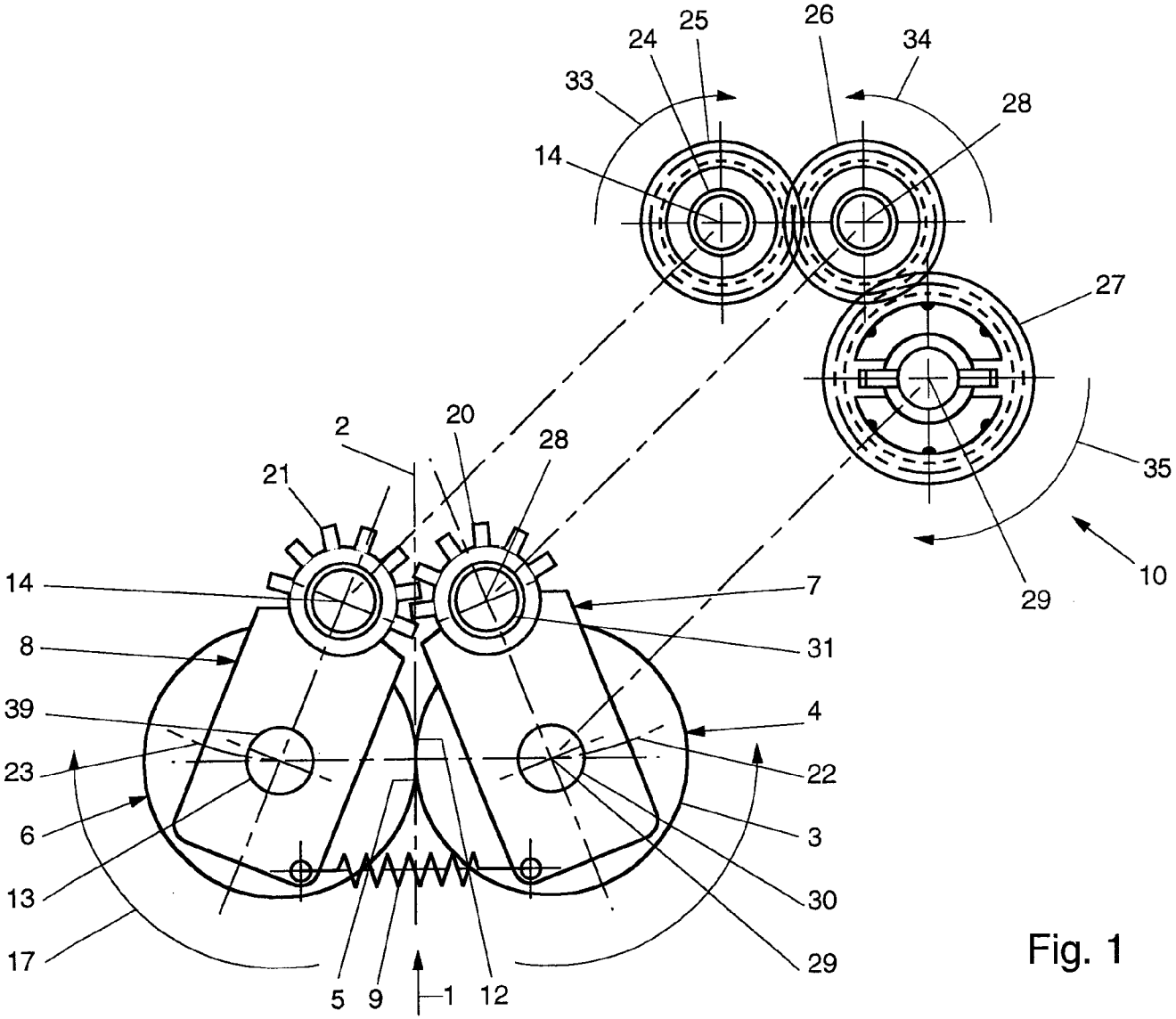
FIG. 1 is an exploded side elevation of a first embodiment of an assembly according to the invention.
Figure 2:
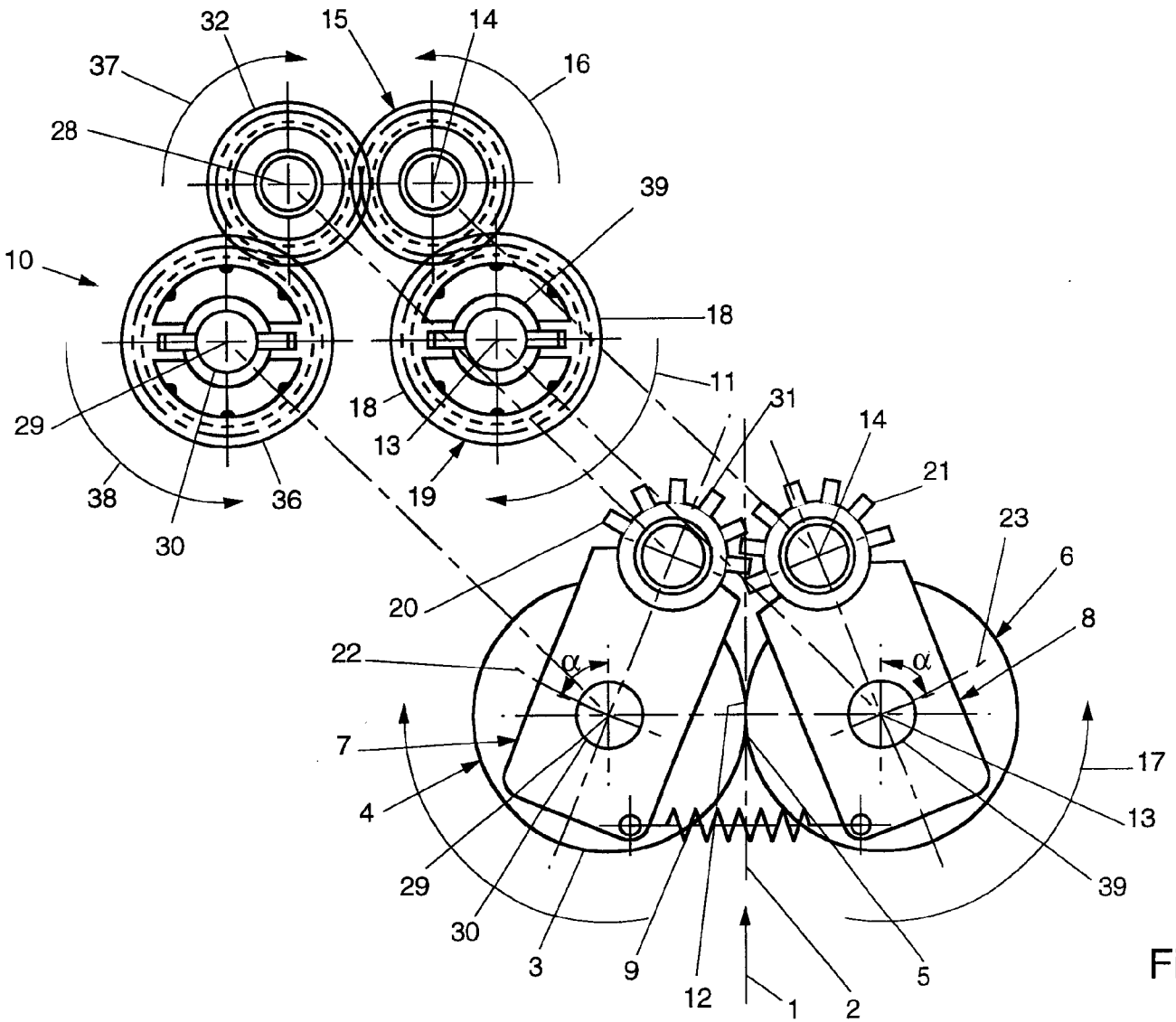
FIG. 2 is an elevation similar to FIG. 1 of the opposite side of the assembly according to FIG. 1.
Figure 3:
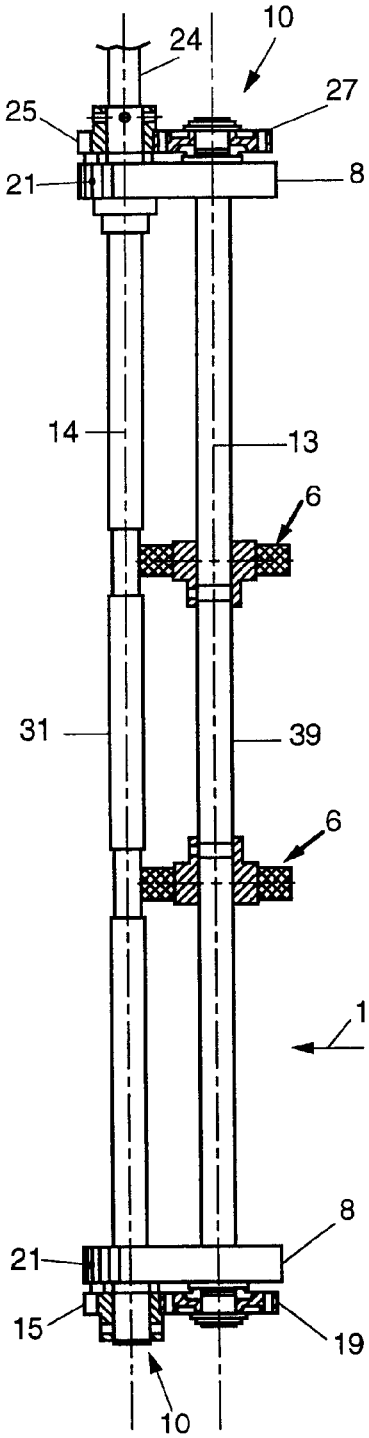
FIG. 3 is a top plan view of the assembly according to FIGS. 1 and 2.
Figure 4:
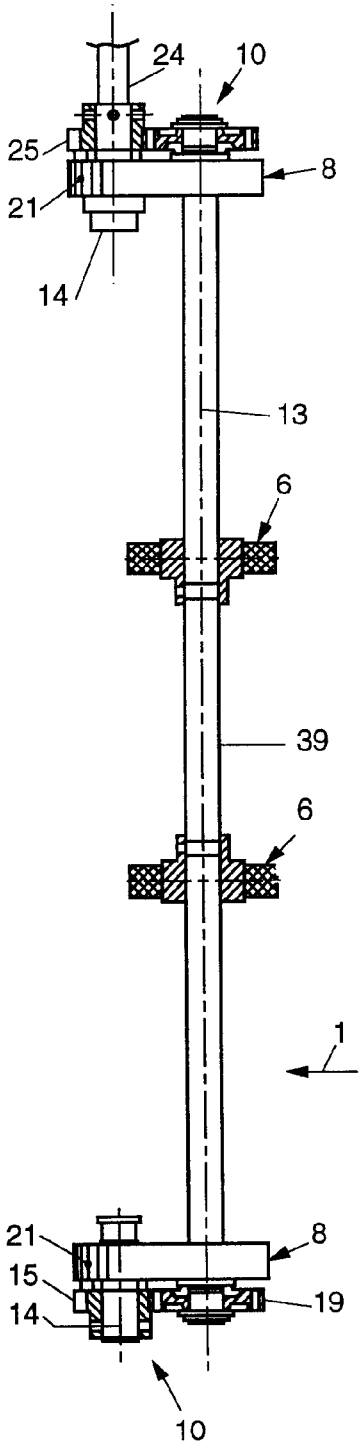
FIG. 4 is a top plan view of a part of the assembly according to FIGS. 1 and 2 situated above a conveying path.
Figure 5:
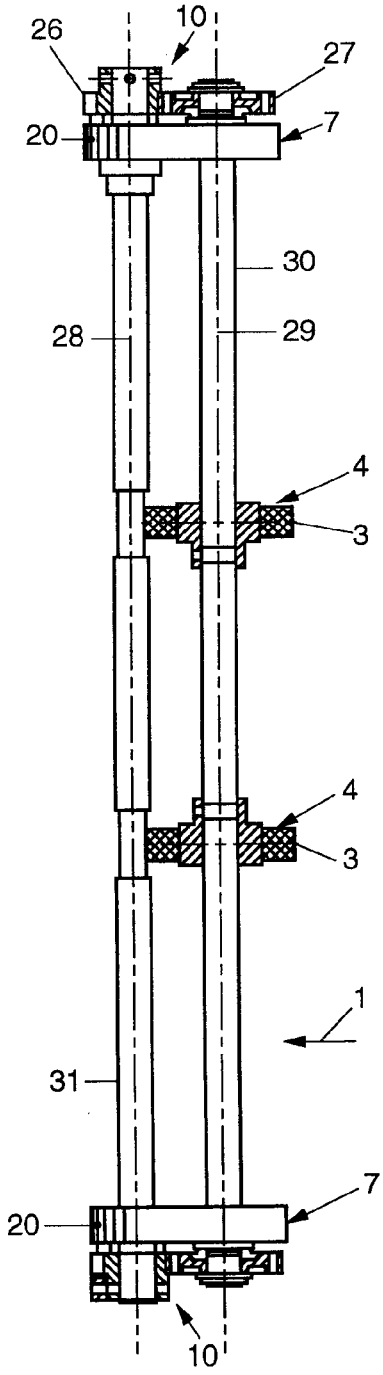
FIG. 5 is a top plan view of a part of the assembly according to FIGS. 1 and 2 situated under a conveying path.

For driving the upper conveyor roller 6 and the lower conveyor roller 4, the assembly is provided with a transmission 10 which is coupled with a drive shaft 11. In FIGS. 1 and 2 gear wheels of the transmission 10 have been drawn, for the sake of clarity, in positions offset with respect to the real position of those gear wheels. The relation between the depicted position and the real position of those gear wheels is indicated with chain-dotted lines.

In operation, the transmission 10 exerts a couple on the upper conveyor roller 6 in a conveying sense indicated by an arrow 11, so that the upper conveyor roller 6 is rotated in such a manner that a circumferential section 12 of the upper conveyor roller 6 facing section 5 of the conveying surface 3 is moved in the conveying direction 1.

The upper conveyor roller 6, which is rotatable about its rotation axis 13, is moreover capable of pivoting about a pivoting axis 14 extending parallel to the rotation axis 13. The lower conveyor roller 4, which is rotatable about its rotation axis 29, is moreover capable of pivoting about a pivoting axis 28 extending parallel to the rotation axis 29. The axes of rotation 13, 29 and the pivoting axes 14, 28 are spaced apart in the conveying direction 1. The transmission 10 comprises a transmission gear 15 which is rotatable coaxially with the pivoting axis 14. This transmission gear 15 is coupled with the upper conveyor roller 6 so as to operatively rotate in the opposite direction to the upper conveyor roller 6. This is indicated in FIG. 2 by an arrow 16.

Because the transmission gear 15 which operatively rotates in the opposite direction to the upper conveyor roller 6 is located downstream of the rotation axis 13 in the conveying direction, the couple which is transferred via the transmission gear 15 and acts in the sense indicated by the arrow 16 results in the exertion on the upper conveyor roller 6 of a force which is directed against the press-on force exerted by the upper conveyor roller 6. The couple transmitted via the transmission gear 15 in the sense indicated by the arrow 16 urges the upper conveyor roller 6, and the suspension 8 in which it is suspended, in the pivoting sense indicated by an arrow 17. Basically the same effect is also obtained with the transmission driving the lower conveyor roller 4.

As a stack of documents passes between the rollers 4, 6, the upper roller 6 is urged against the press-on force generated by the spring 9, so as to provide room between the rollers 4, 6 for the passing stack of documents. As a result, the resistance encountered by the drive is temporarily increased. As a reaction, at the same time the couple exerted on the upper conveyor roller 6 is temporarily increased and the rotary speed of the conveyor roller temporarily decreases somewhat. Because the increase of the couple exerted on the upper conveyor roller 6 also results in a reduction of the press-on force exerted by the upper conveyor roller 6 in the direction of the opposite section 5 of the conveying surface 3, the temporary increase of the couple, and hence the peak load of the assembly, upon entry of the leading edge of a stack of documents is limited and so are attendant sound emissions. Speed variations of the conveyor roller 6 are likewise limited, so that mutual shifting of documents in the stack is likewise limited.

Because the transmission gear 15 is bearing-mounted coaxially with the pivot 14 of the suspension 8 of the upper conveyor roller, it can be simply coupled with, on the one hand, a motor mounted fixedly as is the pivot 14, and, on the other hand, the conveyor roller 6 capable of pivoting about the pivot 14.

The upper conveyor roller 6 moreover exerts a friction force on the documents in the conveying direction 1. This results in a reaction force against the conveying direction 1, which is exerted by the documents on the upper conveyor roller 6. Owing to the pivoting axis 14 being located downstream of the rotation axis 13 of the upper conveyor roller 6 and on the same side of the rotation axis 13 as the conveying path 2, the reaction force against the conveying direction 1 exerted by the entering documents on the conveyor roller contributes to the further reduction of the press-on force during the infeed of a stack of documents.

The transmission gear 15 has a rotary contour in direct engagement with a rotary contour extending coaxially with the upper conveyor roller 6 and restrained from rotation relative to the upper conveyor roller 6, in the form of a toothing 18 of a gear wheel 19 coaxial with the upper conveyor roller 6. This provides a direct transmission from the transmission gear 15, rotatable about the pivoting axis 14, to a rotary contour 18 coaxial with the conveyor roller 6, which can be realized in a constructionally simple manner. Moreover, the distance between the pivoting axis 14 and the rotation axis can be chosen to be very short in this construction, so that the couple transmitted by the transmission gear 15 via a correspondingly short arm results in a correspondingly large reduction of the press-on force. This provides for a relatively great influence on the press-on force through the transmitted driving couple.

The conveying surface 3 opposite the upper conveyor roller 6 extends over the lower conveyor roller, which is reciprocable relative to the upper conveyor roller 6 between positions at different distances from the first-mentioned conveyor roller. The spring 9 ensures that the lower conveyor roller 4 operatively exerts a press-on force in the direction of the upper conveyor roller 6. Owing to both opposite conveyor rollers 4, 6 thus being movable between positions at different mutual distances, the distance over which conveyor rollers must move during the infeed of a stack of documents can be divided between the opposite conveyor rollers 4, 6 on opposite sides of the conveying path 2. This further facilitates the infeed of a package of documents and further limits relative displacement of documents in a stack during infeed.

The suspensions 7, 8 associated with the conveyor rollers 4, 6 are mutually coupled in such a manner that if one of the conveyor rollers 4, 6 moves away from the conveying path 2, the other of the conveyor rollers 4, 6 also moves away from the conveying path 2. As a result, the position of a conveyed stack relative to the conveying path 2 is always well controlled. This is of importance, for instance, when receiving a conveyed stack from upstream conveying means, and for delivering a conveyed stack to downstream conveying means.

More particularly, the suspensions 7, 8 are mutually coupled in such a manner that the conveyor rollers 4, 6 are always located in mirror-symmetrical positions relative to the conveying path 2. The center of a conveyed stack therefore coincides at all times with the same median plane of the conveying path 2.

The mutual coupling between the suspensions 7, 8 has been obtained in a simple manner in that the suspensions 7, 8 are each provided with a toothing 20, 21 extending coaxially with the pivoting axis 14, these toothings 20, 21 being in mesh.

In FIGS. 1 and 2, the paths along which the conveyor rollers 4, 6 are movable relative to the conveying path 2 are indicated by chain-dotted lines 22, 23. The angle α between the conveying path 2 and the sides of each of the paths 22, 23 directed in the conveying direction 1 is always less than 90°, so that the rollers 4, 6, when moving away from the conveying path 2, move with a directional component in the conveying direction 1. Owing to displacements away from the conveying path 2 being accompanied by a displacement of the rollers 4, 6 in the conveying direction 1, a temporary acceleration in the conveying direction of the sections 5, 12 of the circumferential surfaces of the conveyor rollers 4, 6 proximal to the conveying path 2 is induced upon infeed of a set of stacked documents. As a result, the couple exerted on the rollers 4, 6 in the conveying sense is temporarily further increased and, as a consequence, the press-on force exerted by the rollers 4, 6 is further reduced. So this contributes further to the prevention of mutual displacements of components of a set, in particular those displacements whereby the outermost components shift relative to more central components of that set against the conveying direction.

For driving the rollers 4, 6, the apparatus comprises a drive shaft 24. Mounted on the drive shaft 24, which is bearing-mounted coaxially with the pivoting axis 14 of the upper suspension 8, is a gear wheel 25. This gear wheel 25 on the drive shaft 24 is in mesh with a transmission gear 26 which is bearing-mounted coaxially with the pivoting axis 28 of the lower suspension 7. This transmission gear 26 in turn is in mesh with a gear wheel 27 which is mounted coaxially with, and non-rotatably relative to, the conveyor rollers 4, on the same shaft 30 as those conveyor rollers 4. The sense of rotation of the gear wheels 25, 26 and 27 in operation is indicated with arrows 33, 34 and 35, respectively.

The transmission gear 26 suspended coaxially with the pivoting axis 28 of the lower suspension 7 is mounted on an intermediate shaft 31 likewise extending coaxially with the lower pivoting axis 28. Mounted on the opposite end of the intermediate shaft 31 is a further transmission gear 32. This further transmission gear 32 is in mesh with the transmission gear 15 suspended coaxially with the pivoting axis 14 of the upper suspension 8 and with a lower gear wheel 36 suspended coaxially with, and non-rotatably relative to, the lower conveyor rollers 4. As has already been described hereinabove, the transmission gear 15 is in mesh with the gear wheel 19 mounted coaxially with, and non-rotatably relative to, the upper conveyor rollers 6. The operative sense of rotation of each of the gears 15, 19, 32, 36 on the left side, as viewed in the conveying direction, of the conveying path 2 and the shaft 31 is indicated with arrows 11, 16, 37 and 38, respectively.

Because one of the two shafts 31, 39 on which the conveyor rollers are mounted, is driven from two sides and the suspensions 7, 8 on opposite sides of the conveying path 2 are mutually coupled, a uniform distribution of the reduction of the press-on force is achieved.

Figure 6:
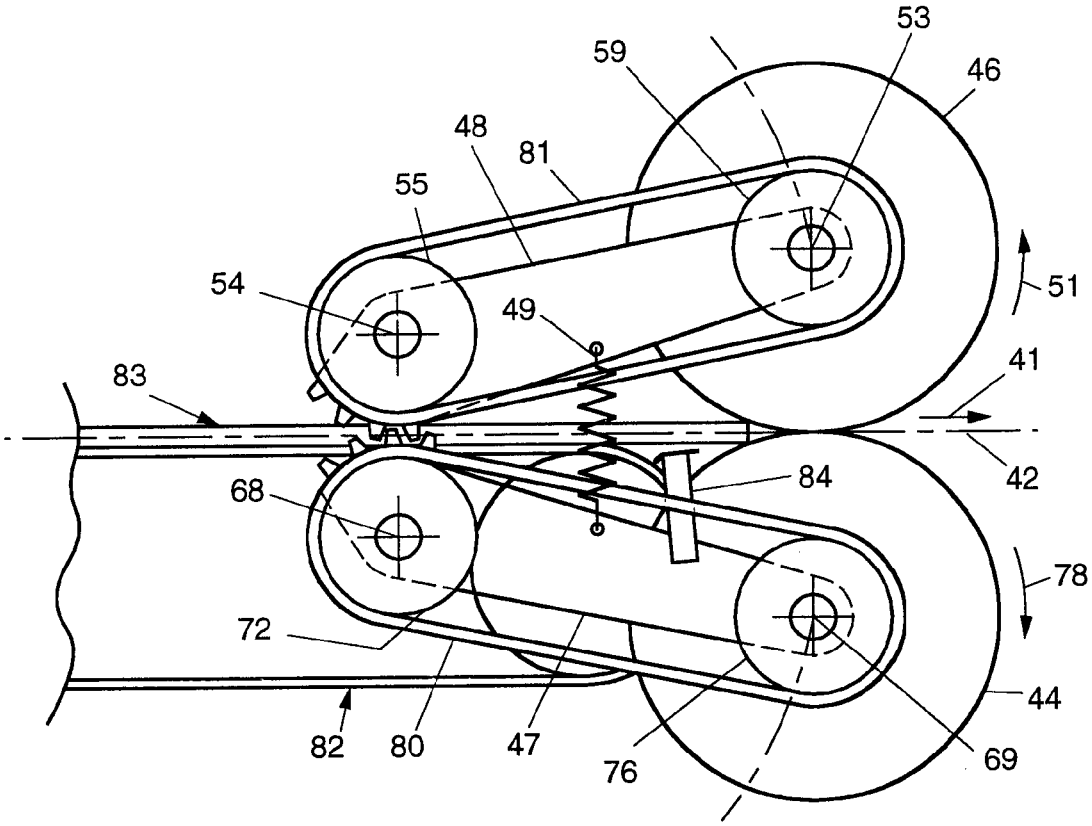
FIG. 6 is a side elevation of a second embodiment of an assembly according to the invention.

FIG. 6 shows an alternative embodiment of the assembly according to the invention, in which transmission gears 55, 72 coupled with a drive (not show-n), are coupled with conveyor rollers 44, 46 through strings. In operation, the transmission gears 55, 72 rotate in the same sense of rotation, indicated by arrows 51, 78, as the conveyor rollers 44, 46. Suspensions 47, 48 of the conveyor rollers 44, 46 can pivot about pivoting axes 54, 68 which, viewed in the conveying direction 41, are located upstream of rotation axes 53, 69 of the conveyor rollers 44, 46, and are pulled towards each other by springs 49. Couples which are exerted by the transmission gears 55, 72 on the suspensions 47, 48 via pulleys 59, 76 coaxial with the conveyor rollers 44, 46, also act in the sense of rotation indicated by the arrows 51, 78 and therefore effect a reduction of the press-on force exerted by the conveyor rollers 44, 46 in the direction of the conveying path 42.

FIG. 6 further shows a downstream portion of a conveyor 82, via which conveyor 82 a set of documents 83 is supplied. In the situation shown, the set of documents 83 is about to enter the nip between the conveyor rollers 44, 46. The conveying surface of the conveyor 83 is disposed somewhat lower than the nip between the conveyor rollers 44, 46. The distance, measured perpendicularly to the conveying direction, between on the one hand the nip between the conveyor rollers 44, 46 and on the other hand the conveying surface of the conveyor 82 is preferred to approximately equal half the largest thickness of the sets to be processed. Arranged between the conveyor 82 and the nip between the conveyor rollers 44, 46 is a lead-in guide 84. This lead-in guide 84 is mounted on the lower suspension 47 and therefore pivots along with the lower conveyor roller 44.

Figure 7:
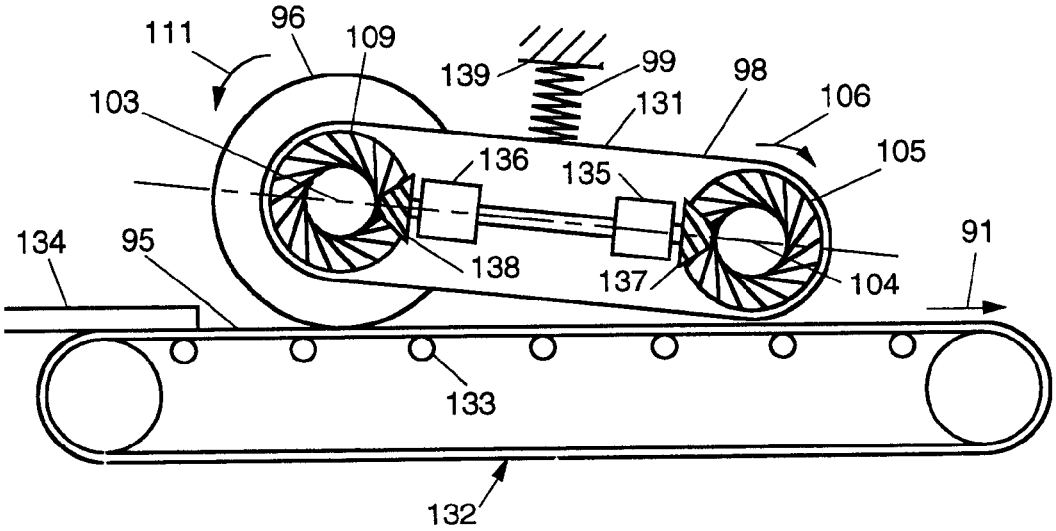
FIG. 7 is a side elevation of a third embodiment of an assembly according to the invention.

FIG. 7 shows another alternative embodiment of the assembly according to the invention, in which, as in the embodiment according to FIGS. 1–5, the rotation axis of the transmission gear 105 and the pivoting axis 104 of the suspension 98 coincide and are located downstream of the rotation axis 103 of the conveyor roller 96. Located opposite the conveyor roller 96 is a belt conveyor 132 of which a section 95 proximal to the conveyor roller 96 forms a conveying surface opposite the conveyor roller 96. The conveyor 132 is provided with seven supporting rollers 133 which support the section 95 of the belt conveyor 132 proximal to the conveyor roller 96. FIG. 7 further shows a set of documents 134 which is supplied via the conveyor 132.

The transmission gear 105 and the gear wheel 109 suspended coaxially with, and non-rotatably relative to, the conveyor roller 96 are of conical design. Arranged between the transmission gear 105 and the gear wheel 109 is a shaft 131 which is bearing-mounted with respect to the suspension 98 by means of bearing elements 135, 136. Adjacent the transmission gear 105 and the gear wheel 109, the shaft 131 is provided with likewise conical gear wheels 137, 138 which cooperate with the transmission gear 105 and the gear wheel 109, respectively. The means for driving the transmission gear 305 can be designed in various ways, known per se, and therefore are not shown.

The press-on force which the conveyor roller 96 in stationary condition exerts in the direction of the conveying surface 95 is determined partly by the weight of the conveyor roller 96, the suspension 98 and any further parts mounted on the suspension 98 and partly by a force exerted by a compression spring 99 between the suspension 98 and a fixed frame portion 139.

When in operation sets of documents 134 are being conveyed in the conveying direction 91, the sense of rotation of the transmission gear 105 and of the conveyor roller 96 is as indicated by arrows 106 and 111, respectively. In operation, the transmission gear 105, via the conical gear 137, the shaft 131, the bearings 135, 136 and the gear wheel 109, exerts on the suspension 98 a couple acting against the press-on force. This couple provides that the effective press-on force exerted in operation is lower according as the driving couple transmitted via the transmission gear 105 is greater. Thus, in reaction to the temporarily increased driving couple upon the infeed of the set of documents 134 between the conveyor roller 96 and the conveying surface 95, the press-on force is temporarily reduced during the infeed of the set of documents 134, which smoothens the infeed of the set of documents and prevents, or at least limits, shifting of uppermost documents of the set 134 relative to the other documents of that set.

Within the framework of the invention, many variants other than the examples described hereinbefore are possible. Instead of being designed as a roller of which a circumferential surface engages passing articles directly, the conveyor rollers can be designed, for instance, as a roller of a conveyor belt, for instance on the side of that conveyor belt that is upstream in operation. The press-on force exerted by the conveyor roller in the direction of the opposite, circulating conveying surface can be produced, rather than by means of a resilient element as described, by means of, for instance, a magnet, a pressure of a fluid or the weight of the conveyor roller and a part of the suspension.

What is claimed is:

1. An assembly for conveying stacked documents along a particular conveying path in a conveying direction, comprising:

a circulating conveying device having a section extending along the conveying path and a conveyor roller which is suspended opposite said section of the circulating conveying surface for reciprocating movement between positions at different distances from said section of the circulating conveying device and in an operating condition continuously exerts a press-on force in the direction of said section of the circulating conveying device to convey a plurality of documents while in a first stack and a second stack, said first stack being spaced from said second stack in a conveying direction, and a transmission for driving the conveyor roller with a couple in the conveying sense, which couple causes the conveyor roller to rotate in operation in such a manner that a circumferential section of the conveyor roller facing said section of the circulating conveying device is moved in the conveying direction, the transmission being coupled with the conveyor roller in such a manner that if the transmission exerts a couple on the conveyor roller in said conveying sense, the transmission also exerts a force on the conveyor roller to reduce said press-on force.

2. An assembly according to claim 1, wherein the conveyor roller is suspended for rotation about its rotation axis and for pivoting movement about a pivoting axis extending parallel to the rotation axis, said rotation axis and said pivoting axis being spaced apart in the conveying direction, and the transmission comprises a transmission gear adapted for rotation coaxial with the pivoting axis.

3. An assembly according to claim 2, wherein the transmission gear is coupled with the conveyor roller so as to operatively rotate in the opposite direction to the conveyor roller, and wherein the pivoting axis is located downstream of the rotation axis in the conveying direction.

4. An assembly according to claim 3, wherein the transmission gear has a rotary contour directly engaging a rotary contour restrained from rotation relative to the conveyor roller and extending coaxially with the conveyor roller.

5. An assembly according to claim 2, wherein said transmission gear is coupled with the conveyor roller so as to operatively rotate in the same sense of rotation as the conveyor roller, and the pivoting axis is located upstream of the rotation axis in the conveying direction.

6. An assembly according to claim 1, wherein the section of the conveying surface located opposite said conveyor roller passes over a second conveyor roller which is suspended for reciprocating movement with respect to the first-mentioned conveyor roller between positions at different distances from the first-mentioned conveyor roller and in operating condition exerts a press-on force in the direction of the first-mentioned conveyor roller.

7. An assembly according to claim 6, wherein the conveyor rollers are each suspended in a respective suspension and the suspensions are mutually coupled in such a manner that if one of the conveyor rollers moves away from the conveying path, the other of the conveyor rollers also moves away from the conveying path.

8. An assembly according to claim 6, wherein the suspensions are mutually coupled in such a manner that the conveyor rollers are located at all times in mirror-symmetrical positions with respect to the conveying path.

9. An assembly according to claim 6, wherein the first suspension and the second suspension are provided with meshing toothings each extending coaxially with one of the pivoting axes.

10. An assembly according to claim 1, wherein the or each conveyor roller is movable-relative to the conveying path along a path which, in a direction away from the conveying path, has a directional component in the conveying direction.

11. A system for conveying stacked documents along a particular conveying path in a conveying direction and for inserting or folding documents, comprising:

a conveying assembly for conveying a plurality of documents while in a first stack and a second stack, said first stack being spaced from said second stack in a conveying direction, said conveying assembly including a circulating conveying surface having a section extending along the conveying path and a conveyor roller which is suspended opposite said section of the circulating conveying surface for reciprocating movement between positions at different distances from said section of the circulating conveying surface and in an operating condition exerts a press-on force in the direction of said section of the circulating conveying surface, and a transmission for driving the conveyor roller with a couple in the conveying sense, which couple causes the conveyor roller to rotate in operation in such a manner that a circumferential section of the conveyor roller facing said section of the conveying surface is moved in the conveying direction, the transmission being coupled with the conveyor roller in such a manner that if the transmission exerts a couple on the conveyor roller in said conveying sense, the transmission also exerts a force on the conveyor roller to reduce said press-on force.

12. A system according to claim 11, wherein said conveyor roller is a first conveyor roller and the section of the conveying surface located opposite said conveyor roller passes over a second conveyor roller which is suspended for reciprocating movement with respect to the first conveyor roller between positions at different distances from the first conveyor roller and in an operating condition exerts a press-on force in the direction of the first conveyor roller.

13. A system according to claim 12, wherein the first and second conveyor rollers are each suspended in a respective suspension and the suspensions are mutually coupled to one another so that when one of the conveyor rollers moves away from the conveying path, the other of the conveyor rollers also moves away from the conveying path.

14. In an assembly which conveys stacked documents along a conveying path in a conveying direction, the assembly comprising:

a circulating conveying device having a section extending along the conveying path and a conveyor roller which is suspended opposite said section of the circulating conveying device for reciprocating movement between positions at different distances from said section of the circulating conveying device and in an operating condition during conveyance of documents continuously exerts a press-on force in the direction of said section of the circulating conveying device to convey a plurality of documents while in a first stack and a second stack, the first stack being spaced from the second stack in a conveying direction, and a transmission for driving the conveyor roller with a couple in the conveying sense that causes the conveyor roller to rotate in operation in such a manner that a circumferential section of the conveyor roller facing said section of the conveying surface is moved in the conveying direction, the transmission being coupled with the conveyor roller so that when the transmission exerts a couple on the conveyor roller in said conveying sense, the transmission also exerts a force on the conveyor roller to reduce said press-on force.

15. An assembly according to claim 14, wherein the conveyor roller is suspended for rotation about its rotation axis and for pivoting movement about a pivoting axis extending parallel to the rotation axis, said rotation axis and said pivoting axis being spaced apart in the conveying direction, and the transmission comprises a transmission gear adapted for rotation coaxial with the pivoting axis.

16. An assembly according to claim 15, wherein the transmission gear is coupled with the conveyor roller to operatively rotate in a direction opposite to the direction of rotation of the conveyor roller, and wherein the pivoting axis is located downstream of the rotation axis in the conveying direction.

17. An assembly for conveying stacked documents along a conveying path in a conveying direction, comprising:

a circulating conveying device having a section extending along the conveying path and a conveyor roller which is suspended opposite said section of the circulating conveying surface for reciprocating movement between positions at different distances from said section of the circulating conveying device and in an operating condition exerts a press-on force in the direction of said section of the circulating conveying device to convey a plurality of documents while in a first stack and a second stack, the first stack being spaced from the second stack in a conveying direction, a transmission for driving the conveyor roller with a couple in the conveying sense, which couple causes the conveyor roller to rotate in operation in such a manner that a circumferential section of the conveyor roller facing said section of the circulating conveying device is moved in the conveying direction, the transmission being coupled with the conveyor roller in such a manner that if the transmission exerts a couple on the conveyor roller in said conveying sense, the transmission also exerts a force on the conveyor roller directed against said press-on force, and said conveyor roller being a first conveyor roller and the section of the conveying device located opposite said first conveyor roller passing over a second conveyor roller which is suspended for reciprocating movement with respect to the first conveyor roller, the first and second conveyor rollers each being suspended in a respective suspension and the suspensions being mutually coupled so that if one of the conveyor rollers moves away from the conveying path, the other of the conveyor rollers also moves away from the conveying path.

18. An assembly according to claim 17, wherein the suspensions are mutually coupled so that the first and second conveyor rollers are located at all times in mirror-symmetrical positions with respect to the conveying path.

19. An assembly according to claim 17, wherein the suspensions are mounted for pivoting movement about respective pivoting axes, the suspensions being provided with meshing toothings each extending coaxially with one of the pivoting axes.

20. An assembly according to claim 17, wherein each conveyor roller is movable relative to the conveying path along a path which, in a direction away from the conveying path, has a directional component in the conveying direction.

21. An assembly for conveying stacked documents along a particular conveying path in a conveying direction, comprising:

a circulating conveying device including a first conveyor roller and a second conveyor roller each mounted on a respective suspension, the second conveyor roller having a circulating conveying surface including a section extending along the conveying path and the first conveyor roller being suspended opposite said section of the circulating conveying surface for reciprocating movement between positions at different distances from said section and in an operating condition continuously exerts a press-on force in the direction of said section to convey a plurality of documents while in a first stack and a second stack, said first stack being spaced from said second stack in a conveying direction, and the first conveyor roller being suspended for pivotal movement about a first pivoting axis and the second conveyor roller being suspended for pivotal movement about a second pivoting axis, the first and second pivoting axes being arranged in a laterally spaced and a mutually parallel relationship, a spring extending between the suspensions for urging the first conveyor roller towards the circulating conveying surface, and a transmission for driving the first conveyor roller with a couple in the conveying sense, which couple causes the first conveyor roller to rotate in operation in such a manner that a circumferential section of the first conveyor roller facing said section of the circulating conveying device is moved in the conveying direction, the transmission being coupled with the first conveyor roller in such a manner that if the transmission exerts a couple on the first conveyor roller in said conveying sense, the transmission also exerts a force on the first conveyor roller to reduce said press-on force applied to the spaced first and second stacks.

* * * * *

UNITED STATES PATENT AND TRADEMARK OFFICE

CERTIFICATE OF CORRECTION

PATENT NO. : 6,308,820 B1
DATED : October 30, 2001
INVENTOR(S) : Christiaan Antoon Munneke It is certified that error appears in the above-identified patent and that said Letters Patent is hereby corrected as shown below:

Title page,
Item [73] Assignee, delete "Hadew" and insert therefor -- Hadewe --.

Signed and Sealed this

Twenty-eighth Day of May, 2002

*Attest:*

*Attesting Officer*

JAMES E. ROGAN
*Director of the United States Patent and Trademark Office*